US010436080B2

(12) United States Patent
Woo et al.

(10) Patent No.: US 10,436,080 B2
(45) Date of Patent: Oct. 8, 2019

(54) MULTIPLE VARIABLE VALVE LIFT APPARATUS

(71) Applicants: Hyundai Motor Company, Seoul (KR); Kia Motors Corporation, Seoul (KR)

(72) Inventors: Soo Hyung Woo, Yongin-si (KR); Jin Wook Son, Suwon-si (KR); You Sang Son, Suwon-si (KR); Seung Kook Han, Hwaseong-si (KR); Back Sik Kim, Osan-si (KR); Wootae Kim, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 29 days.

(21) Appl. No.: 15/833,405

(22) Filed: Dec. 6, 2017

(65) Prior Publication Data

US 2018/0334933 A1 Nov. 22, 2018

(30) Foreign Application Priority Data

May 16, 2017 (KR) ..... 10-2017-0060520

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/053* (2013.01); *F01L 1/34* (2013.01); *F01L 1/185* (2013.01);
(Continued)

(58) Field of Classification Search
CPC ..... F01L 13/0036; F01L 2001/0473; F01L 1/053; F01L 1/34; F01L 1/185; F01L 2013/0052
(Continued)

(56) References Cited

U.S. PATENT DOCUMENTS 4,404,937 A 9/1983 Leitermann
5,307,768 A 5/1994 Beier et al.
(Continued)

FOREIGN PATENT DOCUMENTS

DE 42 30 877 A1 4/1993
DE 19611641 C1 * 6/1997 ..... F01L 1/053
(Continued)

*Primary Examiner* — Ching Chang
(74) *Attorney, Agent, or Firm* — Morgan, Lewis & Bockius LLP

(57) ABSTRACT

A multiple variable valve lift apparatus may include a moving cam formed of a hollow cylindrical shape, configured to be moveable in an axial direction of a camshaft while being rotated with the camshaft, and forming a plurality of cams implementing a cam guide protrusion device and different valve lifts from each other; an operation device selectively guiding a cam guide protrusion device to move the moving cam in the axial direction of the camshaft; a controller configured for controlling an operation of the operation device; a valve opening/closing device in contact with any one cam among the plurality of cams; a plurality of stopper grooves formed at an external circumference of the camshaft; and a stopper device provided at the moving cam and inserted to the stopper groove to be rotated at a position after the moving cam is moved.

8 Claims, 8 Drawing Sheets

(51) Int. Cl.
*F01L 1/053* (2006.01)
*F01L 1/18* (2006.01)

(52) U.S. Cl.
CPC . *F01L 2013/0052* (2013.01); *F01L 2013/101* (2013.01); *F01L 2105/00* (2013.01); *F01L 2201/00* (2013.01); *F01L 2820/031* (2013.01)

(58) Field of Classification Search
USPC ..... 123/90.18, 90.6, 90.16, 90.39, 90.44
See application file for complete search history.

(56) References Cited

U.S. PATENT DOCUMENTS

| | | | | |
|---|---|---|---|---|
| 6,425,359 | B2 | 7/2002 | Fujii et al. | |
| 7,409,938 | B2 | 8/2008 | Dengler | |
| 7,472,671 | B2 | 1/2009 | Elendt et al. | |
| 7,762,225 | B2 | 7/2010 | Dengler | |
| 8,297,247 | B2 * | 10/2012 | Schoeneberg | F01L 1/047 123/90.18 |
| 2005/0011480 | A1 | 1/2005 | Schultz et al. | |
| 2007/0178731 | A1 | 8/2007 | Elendt | |
| 2010/0108006 | A1 | 5/2010 | Elendt et al. | |
| 2010/0224154 | A1 | 9/2010 | Elendt et al. | |
| 2010/0251982 | A1 | 10/2010 | Elendt et al. | |
| 2011/0247577 | A1 | 10/2011 | Elendt et al. | |
| 2012/0006292 | A1 | 1/2012 | Elendt et al. | |
| 2012/0024245 | A1 | 2/2012 | Nendel | |

FOREIGN PATENT DOCUMENTS

| | | | |
|---|---|---|---|
| DE | 101 48 243 | A1 | 4/2003 |
| EP | 0 798 451 | A1 | 10/1997 |
| JP | 3926541 | B2 | 6/2007 |
| JP | 2015-132225 | A | 7/2015 |

* cited by examiner

MULTIPLE VARIABLE VALVE LIFT APPARATUS

CROSS-REFERENCE(S) TO RELATED APPLICATIONS

The present application claims priority to Korean Patent Application No. 10-2017-0060520, filed on May 16, 2017, the entire contents of which is incorporated herein for all purposes by this reference.

BACKGROUND OF THE INVENTION

Field of the Invention

The present invention relates to a multiple variable valve lift apparatus. More particularly, the present invention relates to a multiple variable valve lift apparatus configured to implement a multiple valve lift while utilizing a simple configuration.

Description of Related Art

In general, internal combustion engines generate power by receiving and combusting air and fuel in a combustion chamber. An intake valve is operated by a camshaft, and air is introduced into the combustion chamber while the intake valve is open. An exhaust valve is also operated by the camshaft, and air is discharged from the combustion chamber while the exhaust valve is open.

Optimal operation of the intake valve and the exhaust valve, however, depends on an RPM of the engine. That is, an appropriate time for lifting or opening/closing the valves depends on the RPM of the engine. To implement an appropriate valve operation in accordance with the RPM of the engine, as described above, a Continuously Variable Valve Lift (CVVL) apparatus having a plurality of shapes of cams operating valves or operates valves at different lifts in accordance with the RPM of the engine has been researched.

A variable valve lift (VVL) apparatus of a cam shift type in which a plurality of cams configured to drive the valve is designed and the plurality of cams move in an axial direction to select the cam driving the valve is important to correctly manage a relative position of the plurality of cams and a valve opening/closing device.

However, when constituent elements guiding the cam shift are deformed by a thermal expansion due to an influence of a sharply changed temperature of the engine, the relative position of the plurality of cams and the valve opening/closing unit may not be correctly managed. Accordingly, a reliability for the cam shift may be deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a multiple variable valve lift apparatus improving the reliability of the cam shift while realizing the multiple valve lift by a simple configuration.

A multiple variable valve lift apparatus according to an exemplary embodiment of the present invention includes a moving cam formed in a hollow cylindrical shape, configured to be moveable in an axial direction of a camshaft while being rotated with the camshaft, and forming a plurality of cams, implementing a cam guide protrusion device and having different valve lifts from each other; an operation device selectively guiding a cam guide protrusion device to move the moving cam in the axial direction of the camshaft; a controller configured to control an operation of the operation device; a valve opening/closing device in contact with any one cam among the plurality of cams to be opened and closed; a plurality of stopper grooves formed at an external circumference of the camshaft; and a stopper device provided at the moving cam and inserted to the stopper groove to be rotated at a position after the moving cam is moved.

The stopper device may include a stopper mounting groove depressed from an internal circumference of the moving cam to an external in a radial direction; a stopper ball inserted to the stopper groove; and an elastic member provided in the stopper mounting groove and elastically supporting the stopper ball.

The stopper ball may be inserted stepwise into the plurality of stopper grooves according to the axial movement of the moving cam.

The cam guide protrusion device may be formed in a plate shape.

The operation device may include a solenoid operated by the controller; and a guide device inserted with the cam guide protrusion device and selectively protruding depending on the operation of the solenoid to guide the cam guide protrusion device.

The plurality of cams may be sequentially disposed in descending order of the implemented valve lift.

The moving cam may be in contact with a cam cap in the axial direction when a largest valve lift or a smallest valve lift is implemented.

The stopper mounting groove may be formed at a portion where the cam of the moving cam is disposed.

The stopper mounting groove may be formed to be depressed in a direction that a lobe of the cam protrudes.

The stopper mounting groove may be formed at the cam of which the valve lift is largest among the plurality of cams.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
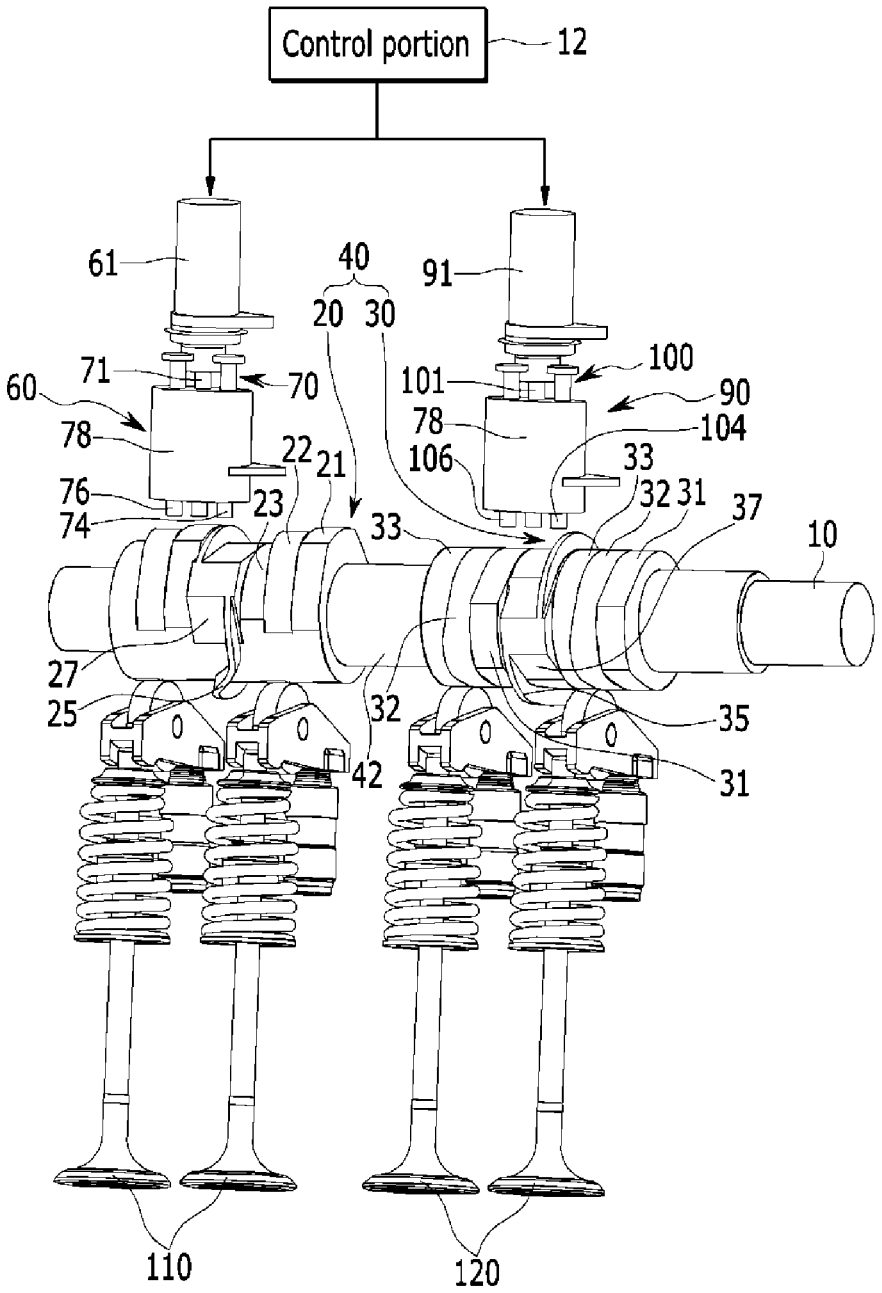
FIG. 1 is a perspective view of a multiple variable valve lift apparatus according to an exemplary embodiment of the present invention.

FIG. 1 is a perspective view of a multiple variable valve lift apparatus according to an exemplary embodiment of the present invention.

As shown in FIG. 1, a multiple variable valve lift apparatus according to an exemplary embodiment of the present invention includes a camshaft 10, a first moving cam 20, in which a plurality of cams 21, 22, and 23 having different shapes from each other are formed, a first cam guide protrusion device 25 is formed, rotated with the camshaft 10 and configured to slide in an axial direction of the camshaft 10, a second moving cam 30, in which a plurality of cams 31, 32, and 33 having different shapes from each other are formed, a second cam guide protrusion device 35 is formed, rotated with the camshaft 10 and configured to slide in the axial direction of the camshaft 10, a first operation device 60 selectively protruding to guide the first cam guide protrusion device 25 and moving the first moving cam 20 in a first direction, a second operation device 90 selectively protruding to guide the second cam guide protrusion device 35 and moving the second moving cam 20 in a second direction, a controller 12 configured to control an operation of the first operation device 60 and the second operation device 90, and valve opening/closing devices 110 and 120 in contact with any one among the plurality of cams 21, 22, 23, 31, 32, and 33.

Three cams 21, 22, and 23 and 31, 32, and 33 are respectively formed in the first moving cam 20 and the second moving cam 30, however the present invention is not limited thereto and a plurality of cams may be formed.

The plurality of cams may be sequentially disposed in descending order of valve lift to be realized. Any one cam, for example, the cam represented by 23 and 33 in FIG. 1 may be a cylinder deactivation (CDA) cam of which the cam lift is "0".

The first cam guide protrusion device 25 and the second cam guide protrusion device 35 have formation directions opposite to each other to respectively move the first moving cam 20 and the second moving cam 30 in the first direction or the second direction thereof. For example, the first cam guide protrusion device 25 may move the first moving cam 20 to a left hand side of the drawing, and the second cam guide protrusion device 35 may move the second moving cam 30 to a right hand side of the drawing.

The first and second operation devices 60 and 90 respectively include first and second solenoids 61 and 91 operated depending the control of the controller 12 and the first and second guide devices 70 and 100 protruded by the first and second solenoids 61 and 91 to respectively move the first and second moving cams 20 and 30 and inserted with the first and second cam guide protrusion devices 25 and 35.

The first and second operation devices 60 and 90 further respectively include a pin housing 78, and the first and second guide devices 70 and 100 further include main pins 71 and 101 provided at the pin housing 78 to be rotated and protrude depending on the operation of the first and second solenoids 61 and 91 and dependent pins 74, 76, 104, and 106 rotatably provided at the pin housings 78 to be engaged to the main pins 71 and 101 and protrude along with the main pins 71 and 101.

FIG. 1 shows that one main pin 71 and 101 and two dependent pins 74, 76, 104, and 106 are provided at each pin housing 78 respectively, however, a number of the main pins 71 and 101 and the dependent pins 74, 76, 104, and 106 is not limited thereto, and the pins may be provided proportional to the number of the plurality of cams 21, 22, 23, 31, 32, and 33.

In the first and second moving cams 20 and 30, inclination portions 27 and 37 are formed wherein the first and second guide devices 70 and 100 are placed in an initial position after moving the first and second moving cams 20 and 30.

The first moving cam 20 and the second moving cam 30 may be connected to move together, or may be integrally formed as one moving cam 40. That is, the first cam guide protrusion device 25 and the second cam guide protrusion device 35 may respectively move the moving cam 40 in the first direction or the second direction thereof. Also, a journal portion 42 of a cylinder shape having a constant radius is formed to connect the first moving cam 20 and the second moving cam 30.

When the main pins 71 and 101 and the dependent pins 74, 76, 104, and 106 protrude wherein the first and second cam guide protrusion devices 25 and 35 are inserted between the main pins 71 and 101 and the dependent pins 74, 76, 104, and 106, the first moving cam 20 and the second moving cam 30, or the moving cam 40 move in the axial direction of the camshaft 10, and the main pins 71 and 101 and the dependent pins 74, 76, 104, and 106 move along the inclination parts 27 and 37 to be placed at the initial position.

Next, the operation of the multiple variable valve lift apparatus according to an exemplary embodiment of the present invention will be described with reference to FIG. 2, FIG. 3, FIG. 4, FIG. 5, FIG. 6, and FIG. 7.

FIG. 2, FIG. 3, FIG. 4, FIG. 5, FIG. 6, and FIG. 7 are operation diagrams of multiple variable valve lift apparatus according to an exemplary embodiment of the present invention.

Figure 2:
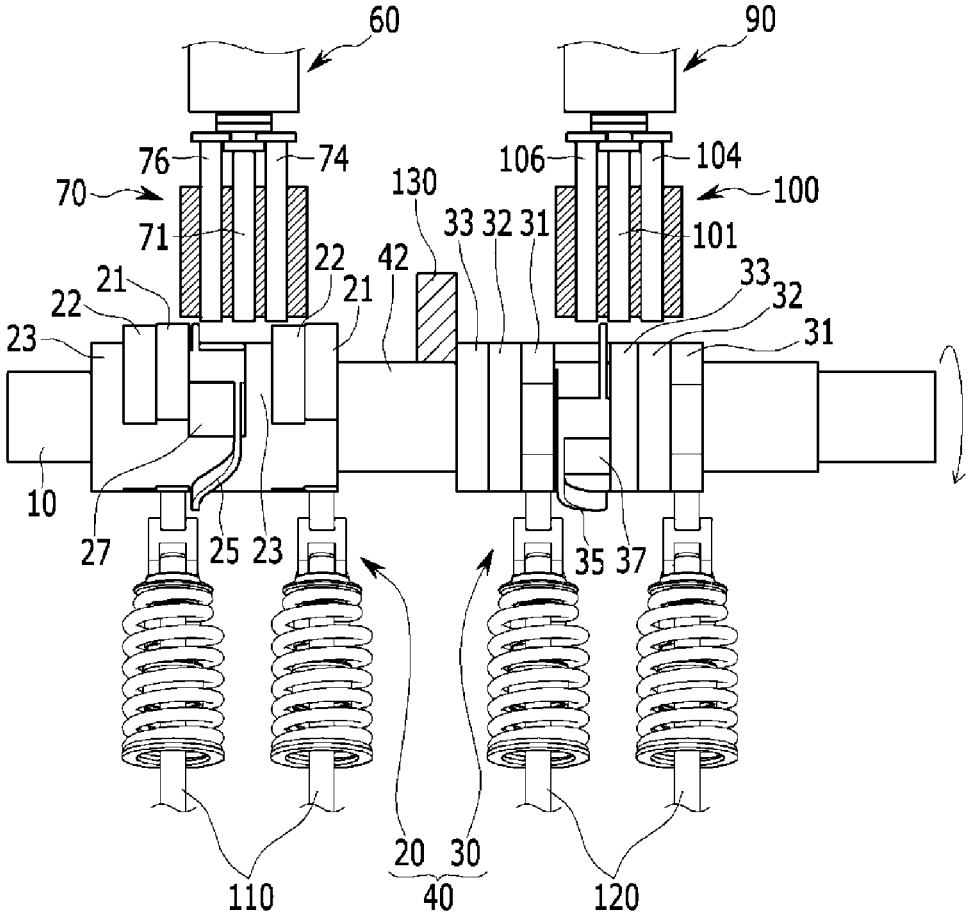
FIG. 2, FIG. 3, FIG. 4, FIG. 5, FIG. 6, and FIG. 7 are operation diagrams of a multiple variable valve lift apparatus according to an exemplary embodiment of the present invention.
Figure 3:
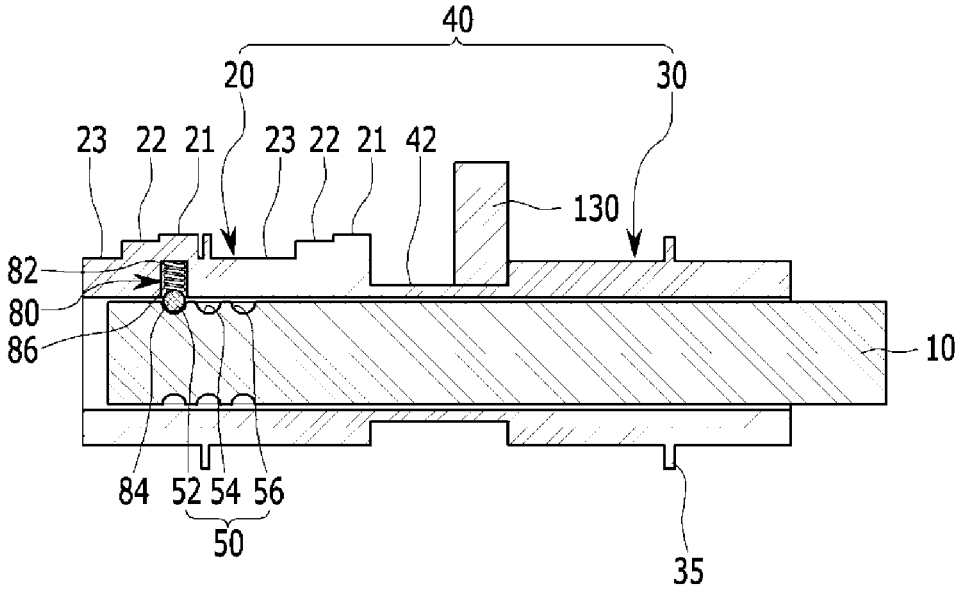
Figure 4:
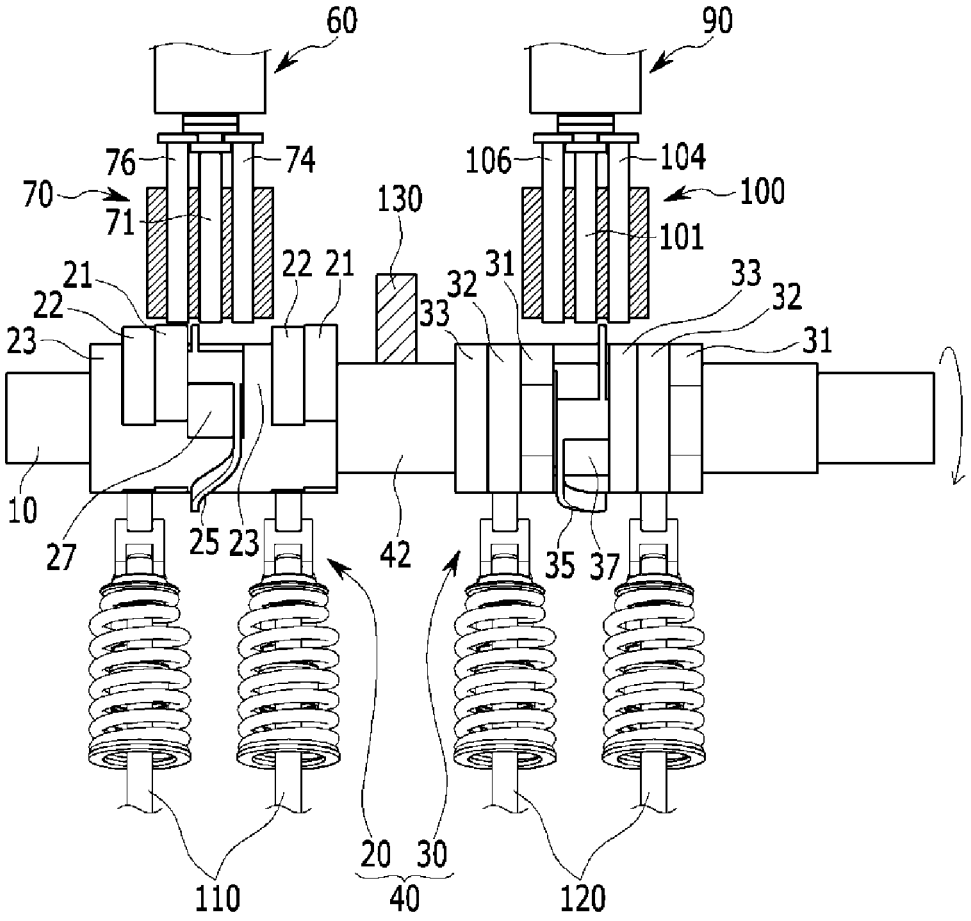
Figure 5:
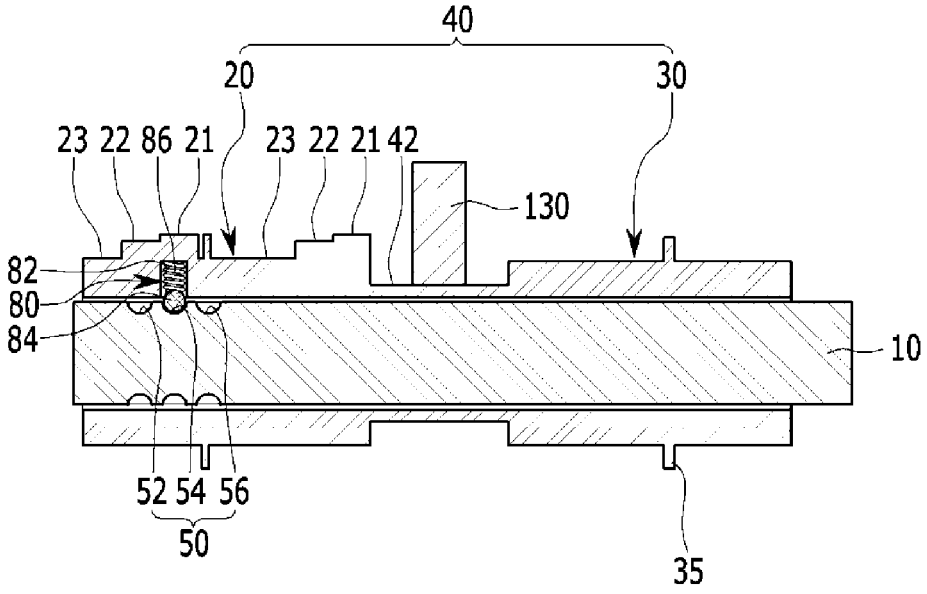
Figure 6:
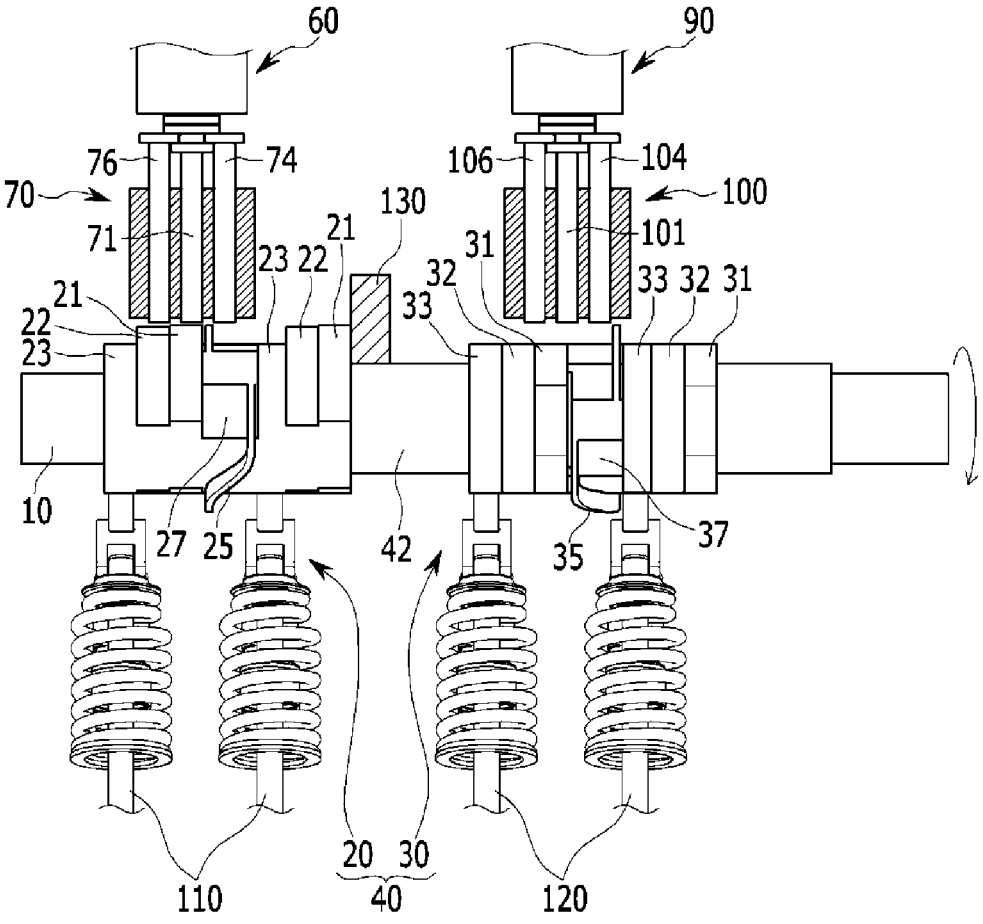
Figure 7:
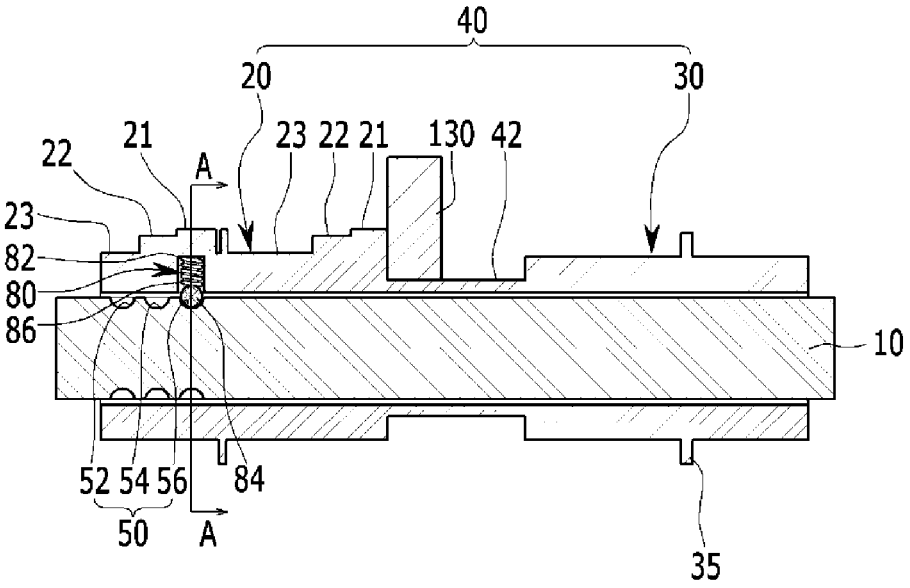

FIG. 3 is a partial cross-sectional view of FIG. 2, FIG. 5 is a partial cross-sectional view of FIG. 4, and FIG. 7 is a partial cross-sectional view of FIG. 6.

As shown in FIG. 3, FIG. 5, and FIG. 7, the multiple variable valve lift apparatus according to an exemplary embodiment of the present invention further includes a stopper groove 50 and a stopper device 80.

The stopper groove 50 is formed on an external circumference of the camshaft 10, which is formed of a cylindrical shape. Also, the stopper groove 50 may be formed in plurality of grooves and may be formed by a number of the valve lift to be realized. FIG. 3, FIG. 5, and FIG. 7 show three stopper grooves 52, 54, and 56.

The stopper device 80 includes a stopper mounting groove 82 formed of a shape depressed towards an external in a radial direction from an internal circumference of the moving cam 40 which is formed of the hollow cylindrical shape, a stopper ball 84 inserted to the stopper groove 50, and an elastic member 86 provided in the stopper mounting groove 82 and elastically supporting the stopper ball 84.

The stopper ball 84 is inserted to the stopper groove 50 allowing the moving cam 40 to be stably rotated at the provided position after the moving.

As shown in FIG. 2 and FIG. 3, in the state that the stopper ball 84 is inserted to the left groove 52 and the valve opening/closing devices 110 and 120 are in contact with the right cams 21 and 31 among the cams, a load of the engine decreases, the controller 12 operates the second operation device 90 wherein the second guide device 100 protrudes. Thus, the second cam guide protrusion device 35 is inserted and guided between the main pin 101 of the second guide device 100 and the left dependent pin 106 thereof. Thus, as shown in FIG. 4 and FIG. 5, the second moving cam 30 and the first moving cam 20 move in the second direction (the right in the drawing), the stopper ball 84 is inserted to the c groove 54, and the valve opening/closing devices 110 and 120 are in contact with the center cams 22 and 32 among the cams to be opened or closed. The valve lift is variable by such steps. Also, the second guide device 100 is placed at the initial position by the inclination portion 37 formed at the second moving cam 30.

When the engine is in a high-speed and high-load state (referring to FIG. 2 and FIG. 3) in which the valve opening/closing devices 110 and 120 are in contact with the right cams 21 and 31 among the cams, the right surface of the cam cap 130, configured to enclose the external circumference of the journal portion 42, is in contact with the second moving cam 30 to prevent leaving of the camshaft 10 according to the rotation of the cams 21, 22, 23, 31, 32, and 33. Accordingly, the moving cam 40 implementing the valve lift by the right cams 21 and 31 among the cams may be stably positioned, and the reliability of the cam shift may be improved.

In the state of FIG. 4 and FIG. 5, when the load of the engine decreases, the controller 12 operates the second operation device 90 to protrude the second guide device 100. Thus, the second cam guide protrusion device 35 is inserted and guided between the main pin 101 of the second guide device 100 and the right dependent pin 104 thereof. Thus, as shown in FIG. 6 and FIG. 7, the second moving cam 30 and the first moving cam 20 move one more time in the second direction (the right side of the drawing), the stopper ball 84 is inserted to the right groove 56, and the valve opening/closing devices 110 and 120 are in contact with the left cams 23 and 33 among the cams to be opened and closed. The valve lift is variable by such steps. Also, the second guide device 100 is placed at the initial position by the inclination portion 37 formed at the second moving cam 30.

When the engine is in a low-speed and low-load state (referring to FIG. 6 and FIG. 7) in which the valve opening/closing devices 110 and 120 are in contact with the left cams 23 and 33 among the cams, the right surface of the cam cap 130 is in contact with the first moving cam 20. Accordingly, the moving cam 40 implementing the valve lift by the left cams 23 and 33 among the cams may be stably positioned, and the reliability of the cam shift may be improved.

In the state of FIG. 6 and FIG. 7, when the load of the engine increases, the controller 12 operates the first operation device 60 to protrude the first guide device 100. For the change of the valve lift depending on the movement of the moving cam 40 in the first direction (the left side of the drawing) by the protrusion of the first guide device 100 and the above-described change of the valve lift depending on the movement of the moving cam 40 in the second direction (the right side of the drawing), only the moving directions of the moving cams 40 are opposite, and the operations thereof are similar wherein the detailed description thereof is omitted.

In general, a region between cams is limited, however the first cam guide protrusion device 25 and the second cam guide protrusion device 35 are formed of a plate shape in the multiple variable valve lift apparatus according to an exemplary embodiment of the present invention, wherein the restriction for the axial direction region of the camshaft 10 may be preserved. For the first cam guide protrusion device 25 and the second cam guide protrusion device 35 formed of the plate shape, the axial direction deformation according to a temperature change of the engine is not sensitive, thus an influence on the operation of the moving cam 40 can be small when the deformation is generated.

Figure 8:
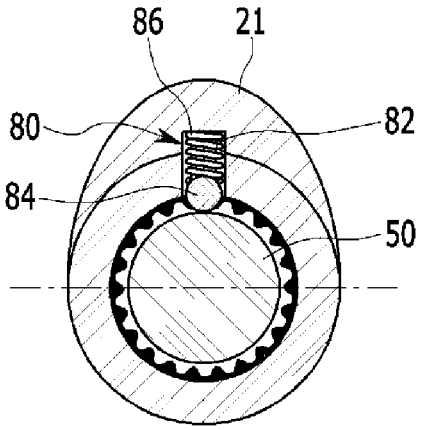
FIG. 8 is a cross-sectional view taken along a line A-A of FIG. 7.

FIG. 8 is a cross-sectional view taken along a line A-A of FIG. 7.

As shown in FIG. 8, the stopper mounting groove 82 is formed at a portion where the cams 21, 22, 23, 31, 32, and 33 forming the moving cam 40. Also, the stopper mounting groove 82 may be formed to depressed in a direction that a lobe of the cam 21, 22, 23, 31, 32, and 33 protrudes. Accordingly, the stopper mounting groove 82 including the elastic member 86 is ensured. That is, a strength of the moving cam 40 where the cams 21, 22, 23, 31, 32, and 33 are formed may be greatest while the stopper mounting groove 82 is formed. Furthermore, a freedom of design of the camshaft 10 including the stopper groove 50 and the stopper device 80 may be also improved. In FIG. 3, FIG. 5, FIG. 7, and FIG. 8, the stopper mounting groove 82 is formed at the right cams 21 and 31 in which the lobe is most protruded among the cams 21, 22, 23, 31, 32, and 33, however the present invention is not limited thereto.

On the other hand, in the moving cam 40 and the camshaft 10 in which a spline is formed for the relative movement in the axial direction, when the stopper mounting groove 82 is formed on the camshaft 10, a process and a mass production of the camshaft 10 may not be easy, and the strength of the camshaft 10 may be deteriorated. However, according to an exemplary embodiment of the present invention, the provided problem may be solved.

As described above, according to an exemplary embodiment of the present invention, the multiple valve lift may be implemented with the simple configuration. Also, as the guide protrusion devices 25 and 35 are formed of the plate shape and the cam cap 130 stabilizes the position of the moving cam 40, thus the reliability for the cam shift 10 of the moving cam 40 may be improved. Furthermore, as the stopper device 80 is provided in the moving cam 40, the strength of the camshaft 10 is secured wherein the durability and the reliability may be improved.

For convenience in explanation and accurate definition in the appended claims, the terms "upper", "lower", "up", "down", "upwards", "downwards", "internal", "outer", "inside", "outside", "inwardly", "outwardly", "internal", "external", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention as well as various alternatives and modifications thereof. It is intended that the scope of the invention be defined by the Claims appended hereto and their equivalents.

What is claimed is:

1. A multiple variable valve lift apparatus comprising:

a moving cam formed of a hollow cylindrical shape, configured to be moveable in an axial direction of a camshaft while being rotated along with the camshaft, and forming a plurality of cams implementing a cam guide protrusion device and having different valve lifts from each other;

an operation device configured to selectively guide the cam guide protrusion device to move the moving cam in the axial direction of the camshaft;

a controller configured to control an operation of the operation device;

a valve opening/closing device in contact with a cam among the plurality of cams to be opened or closed;

a plurality of stopper grooves formed at an external circumference of the camshaft; and a stopper device provided at the moving cam and engaged to one of the stopper grooves to be rotated at a position after the moving cam is moved, wherein the stopper device includes:

a stopper mounting groove depressed from an internal circumference of the moving cam to an external in a radial direction thereof;

a stopper ball configured to be inserted to the one of the stopper grooves; and an elastic member provided in the stopper mounting groove and elastically supporting the stopper ball, wherein the stopper mounting groove is formed at a portion where the cam among the plurality of cams is disposed, and wherein the stopper mounting groove is formed at the cam having a valve lift which is largest among the plurality of cams.

2. The multiple variable valve lift apparatus of claim 1, wherein the stopper ball is inserted stepwise to the plurality of stopper grooves according to an axial direction movement of the moving cam.

3. The multiple variable valve lift apparatus of claim 1, wherein the cam guide protrusion device is formed of a plate shape.

4. The multiple variable valve lift apparatus of claim 1, wherein the operation device includes:

a solenoid operated by the controller; and a guide device inserted with the cam guide protrusion device and selectively protruding depending on an operation of the solenoid to guide the cam guide protrusion device.

5. The multiple variable valve lift apparatus of claim 1, wherein the plurality of cams is sequentially disposed in descending order of an implemented valve lift.

6. The multiple variable valve lift apparatus of claim 5, wherein the moving cam is in contact with a cam cap in the axial direction of the camshaft when the largest valve lift or a smallest valve lift is implemented.

7. The multiple variable valve lift apparatus of claim 1, wherein the stopper mounting groove is formed to be depressed in a direction that a lobe of the cam among the plurality of cams protrudes.

8. The multiple variable valve lift apparatus of claim 1, wherein one of the plurality of cams has a zero lift.

* * * * *